US012696974B2

(12) United States Patent
Tartal et al.

(10) Patent No.: US 12,696,974 B2
(45) Date of Patent: Aug. 4, 2026

(54) POSTAL SERVICE CART INCLUDING A MOBILE CUSTOMER SERVICE TERMINAL

(71) Applicant: United States Postal Service, Washington, DC (US)

(72) Inventors: William A. Tartal, Baltimore, MD (US); Joel Dewnandan, Bladensburg, MD (US); Gabriel M. Yessin, Arlington, VA (US); Joram Shenhar, Fairfax, VA (US)

(73) Assignee: UNITED STATES POSTAL SERVICE, Washington, DC (US)

( * ) Notice: Subject to any disclaimer, the term of this patent is extended or adjusted under 35 U.S.C. 154(b) by 811 days.

(21) Appl. No.: 18/165,616

(22) Filed: Feb. 7, 2023

(65) Prior Publication Data

US 2024/0260744 A1 Aug. 8, 2024

(51) Int. Cl.
*A47B 21/04* (2006.01)
*A47B 31/00* (2006.01)

(52) U.S. Cl.
CPC ..... *A47B 21/04* (2013.01); *A47B 31/00* (2013.01); *A47B 2200/0023* (2013.01)

(58) Field of Classification Search
CPC .. A47B 21/04; A47B 31/00; A47B 2200/0023
See application file for complete search history.

(56) References Cited

U.S. PATENT DOCUMENTS

| | | | | |
|---|---|---|---|---|
| 6,298,794 | B1 * | 10/2001 | Brown | A47B 21/00 108/50.01 |
| 6,397,761 | B1 * | 6/2002 | Moore | A47B 17/00 108/50.01 |
| 7,032,522 | B2 * | 4/2006 | George | A61B 5/742 108/50.01 |
| 8,726,814 | B1 * | 5/2014 | Matteo | A47B 9/16 248/292.12 |
| 8,804,321 | B2 * | 8/2014 | Kincaid | H04N 7/142 312/265.6 |
| 9,027,940 | B2 * | 5/2015 | Ergun | A47B 41/02 280/47.26 |
| 9,067,682 | B2 * | 6/2015 | Pajic | A47B 23/00 |

(Continued)

FOREIGN PATENT DOCUMENTS

| | | | | |
|---|---|---|---|---|
| CN | 114794721 A | * | 7/2022 | A47J 27/21041 |
| CN | 114995606 A | * | 9/2022 | A47B 21/0314 |

(Continued)

*Primary Examiner* — Jacob B Meyer
(74) *Attorney, Agent, or Firm* — CANTOR COLBURN LLP

(57) ABSTRACT

A postal service cart includes a base member and a support member extending from the base member. The support member includes a first end connected with the base member and a second end. A system support surface is connected to the support member at the second end. The system support surface includes a first support zone configured to support a first portion of a customer interface system and a second support zone including a component placement location restrictor configured to support a second portion of the customer interface system. The component placement location restrictor confines placement of the second portion of the customer interface system to a section of the second support zone adjacent the forward edge.

12 Claims, 4 Drawing Sheets

(56) References Cited

U.S. PATENT DOCUMENTS

| | | | | |
|---|---|---|---|---|
| 9,367,984 | B2 * | 6/2016 | Daugbjerg | E05B 65/46 |
| 9,756,936 | B1 * | 9/2017 | Raghavan | A47B 31/00 |
| 9,775,430 | B2 * | 10/2017 | Abu-Akel | A47B 21/02 |
| 10,813,450 | B2 * | 10/2020 | Albers | A47B 9/20 |
| 11,076,687 | B2 * | 8/2021 | Blewett | B62B 3/12 |
| 11,129,471 | B1 * | 9/2021 | Oglesby | A47B 13/023 |
| 12,042,039 | B2 * | 7/2024 | Simon | A47B 23/046 |
| 12,049,248 | B2 * | 7/2024 | Love | B60B 33/0089 |
| 12,085,985 | B2 * | 9/2024 | Sung | A47B 21/00 |
| 2007/0227409 | A1 * | 10/2007 | Chu | A47B 21/00 108/50.02 |
| 2007/0228680 | A1 * | 10/2007 | Reppert | A61G 12/001 280/47.35 |
| 2010/0213679 | A1 * | 8/2010 | Smith | B62B 3/10 280/727 |
| 2024/0260744 | A1 * | 8/2024 | Tartal | A47B 31/00 |

FOREIGN PATENT DOCUMENTS

| | | | | |
|---|---|---|---|---|
| KR | 200357087 | Y1 * | 7/2004 | A47B 21/04 |
| WO | WO-9819903 | A1 * | 5/1998 | B60G 99/00 |
| WO | WO-9922624 | A1 * | 5/1999 | A47C 9/02 |
| WO | WO-9962375 | A2 * | 12/1999 | A47B 21/00 |
| WO | WO-2010098752 | A1 * | 9/2010 | A47B 21/0314 |

* cited by examiner

POSTAL SERVICE CART INCLUDING A MOBILE CUSTOMER SERVICE TERMINAL

BACKGROUND OF THE INVENTION

Exemplary embodiments pertain to the art of mobile customer service terminals and, more particularly, to a postal service cart including a mobile customer service terminal.

A typical post office includes a walk up counter manned by one or more postal employees. Patrons wait in line to interact with the postal employee to mail a letter and/or package. The patron will present the letter and/or package to the postal employee to be weighed. Based on the weight and the dimensions of the letter and/or package a postal rate will be established. Other factors such as letter and/or package destination, speed of delivery, tracking, insurance, and the like may factor into establishing the postal rate. After receiving payment, the postal employee prints out a postage label and sends the letter and/or package to the destination.

Depending on how many people are in line, mailing a letter and/or package can take time. While some patrons require full service, e.g., weighing and printing out the postage label, other patrons simply want to drop off a package or are mailing a package having a fixed rate. Such patrons require little if no interaction with a postal employee and expect a minimal wait time. If lines are long, that expectation may not be met. Accordingly, it would be desirable to provide a solution that would allow postal patrons a self-service option for generating a postage label and shipping packages/letters without the need to interact with a postal employee.

BRIEF DESCRIPTION OF THE INVENTION

A postal service cart includes a base member and a support member extending from the base member. The support member includes a first end connected with the base member and a second end. A system support surface is connected to the support member at the second end. The system support surface includes a first support zone configured to support a first portion of a customer interface system and a second support zone including a component placement location restrictor configured to support a second portion of the customer interface system. The component placement location restrictor confines placement of the second portion of the customer interface system to a section of the second support zone adjacent the forward edge.

A mobile customer service system includes a postal service cart including, a base member and a support member extending from the base member. The support member includes a first end connected with the base member and a second end. A system support surface is connected to the support member at the second end. The system support surface includes a first support zone and a second support zone. A first customer interface system including an input terminal is supported on the system support surface in the first support zone. A second customer interface zone including a component placement location restrictor is defined on the system support surface in the second support zone. A second customer interface system is arranged on the system support surface in the second support zone. The component placement location restrictor confining placement of the second customer interface system to a section of the second support zone adjacent the forward edge.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
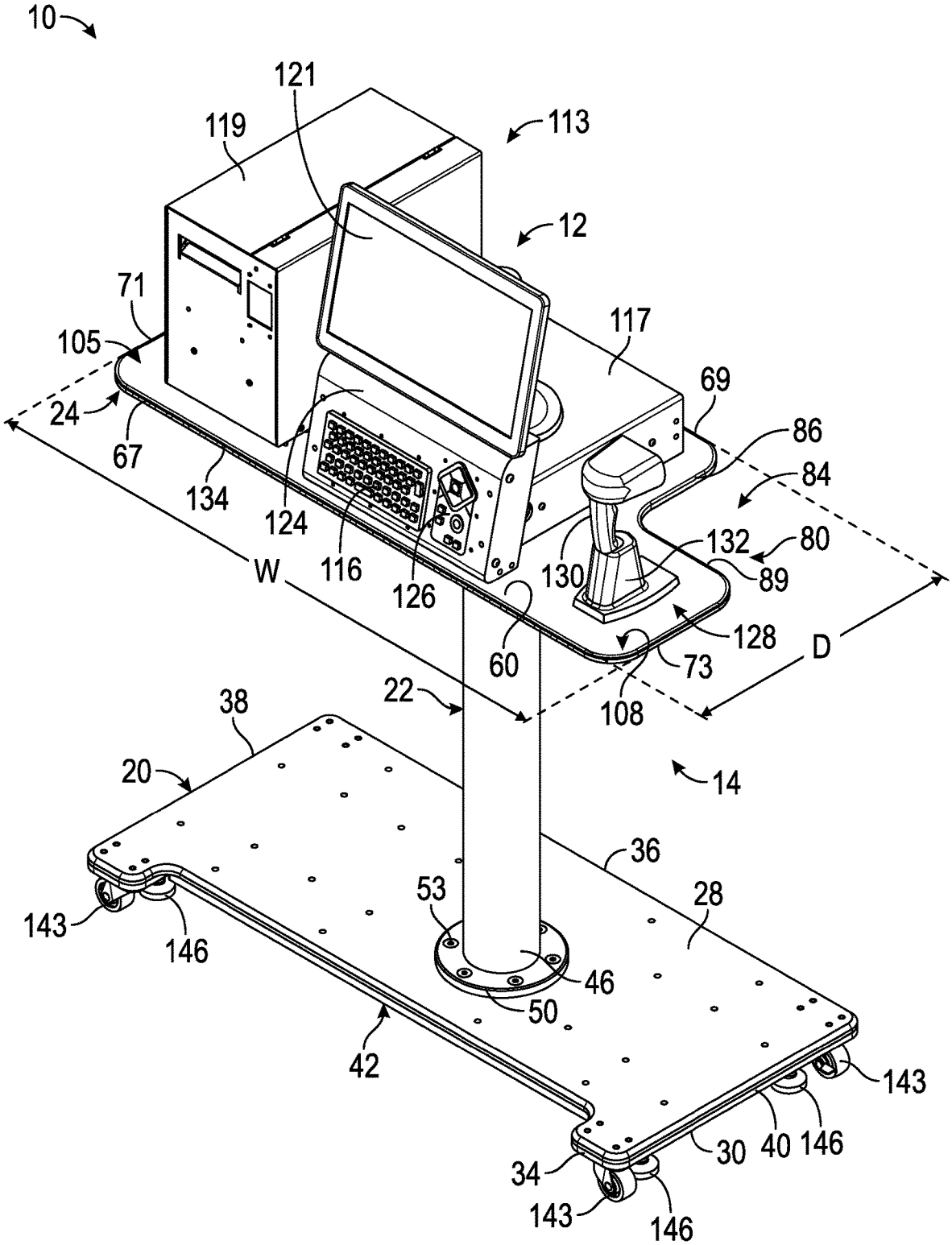
FIG. 1 is an upper right perspective view of a postal service cart including a mobile customer service terminal, in accordance with a non-limiting example.
Figure 2:
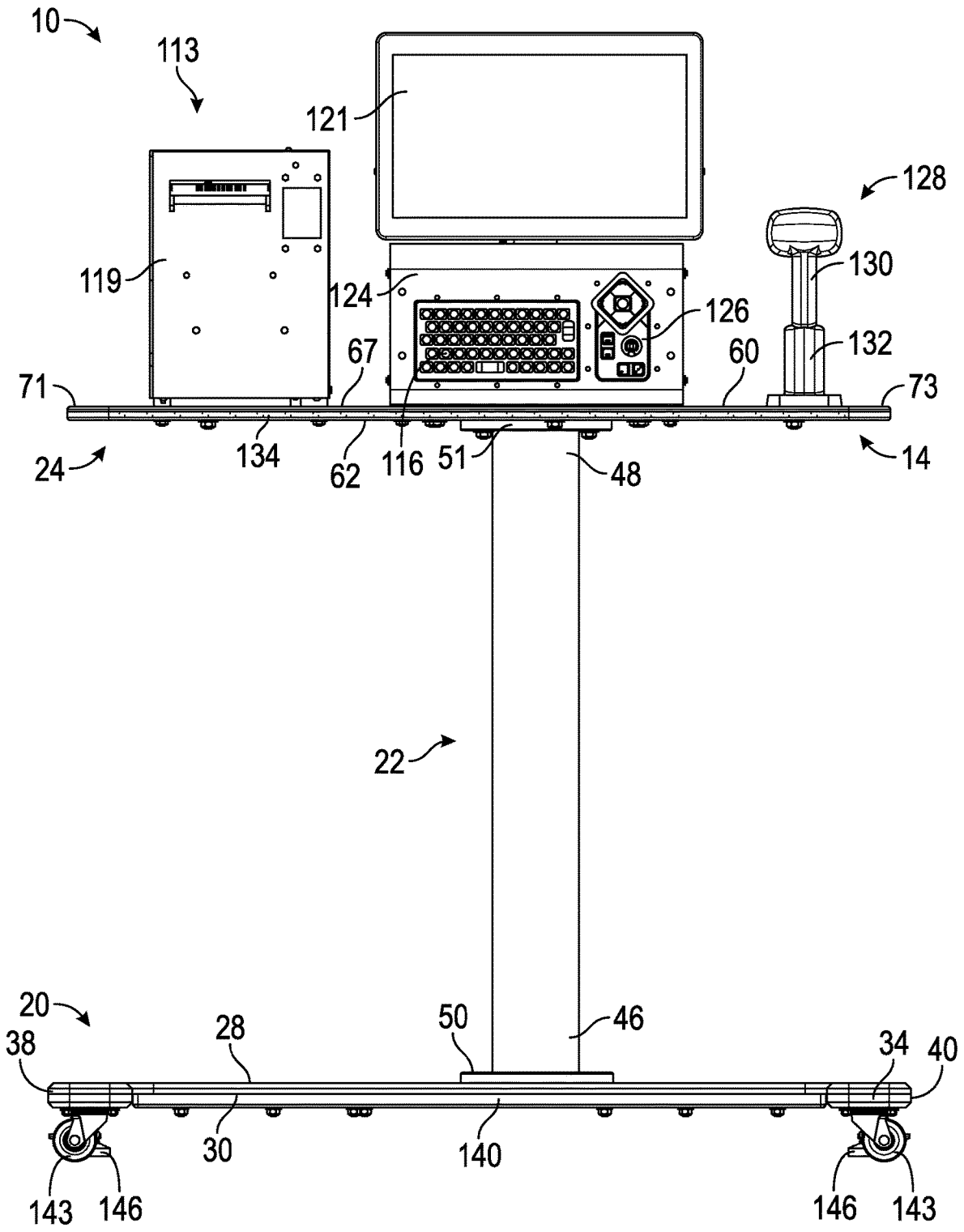
FIG. 2 depicts a front elevational view of the postal service cart of FIG. 1, in accordance with a non-limiting example.
Figure 3:
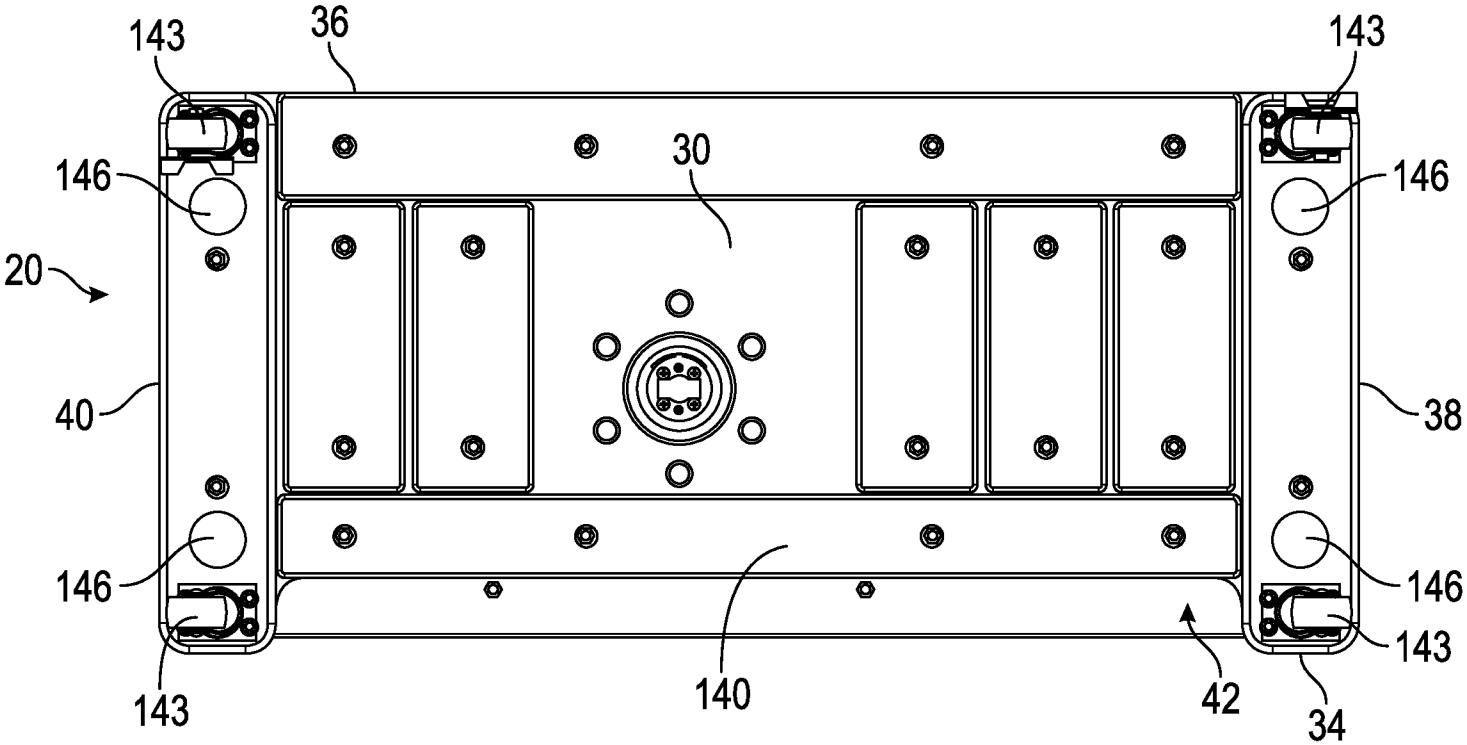
FIG. 3 is a bottom plan view of the postal service cart of FIG. 1, in accordance with a non-limiting example.

A mobile customer service station, in accordance with a non-limiting example, is indicated generally at 10 in FIGS. 1 and 2. Mobile customer service station 10 may take the form of a postal service cart 14 that includes a base member 20, a support member 22 extending from base member 20, and a system support surface 24 positioned on support member 22. Base member 20 includes a first base surface 28 and an opposing second base surface 30 (FIG. 3). Base member 20 is further shown to include a forward edge portion 34, a rear edge portion 36, a first side portion 38 and a second side portion 40. In a non-limiting example, forward edge portion 34 includes a recess 42 that provides greater access to system support surface 24 for customers that may have reach limitations such as, but not limited to, individuals confined to a wheelchair or rolling seat.

In a non-limiting example, support member 22 includes a first end 46 and a second end 48. First end 46 is connected to first base surface 28 and second end 48 is connected to system support surface 24. A first flange 50 is connected to first end 46 and provides an interface between first end 46 and first base surface 28. A second flange 51 is connected to second end 48 and provides an interface between second end 48 and system support surface 24. A plurality of mechanical fasteners, such as shown at 53, join first flange 50 to first base surface 28. Second flange 51 is secured to system support surface 24 in a similar manner. In accordance with a non-limiting example, support member 22 has a fixed length that establishes a selected height of system support surface 24 so as to be accessible to a wide range of patrons. However, it should be understood, that support member 22 may be adjustable to accommodate an even wider range of patrons.

In a non-limiting example, system support surface 24 includes a first support surface 60 and a second support surface 62. Second support surface 62 is opposite to first support surface 60. System support surface 24 includes a forward edge 67, a rear edge 69, a first side edge 71, and a second side edge 73. Forward edge 67 is spaced from rear edge 69 so as to define a surface depth "D" of system support surface 24. First side edge 71 is spaced from second side edge 73 so as to define a surface width "W" of system support surface 24.

In accordance with a non-limiting example, system support surface 24 includes a component placement location restrictor 80 that limits where a component may be placed on first support surface 60 as will be detailed herein. By confining component placement to a limited area on first support surface 60, customers having reach limitations may readily access the component. In a non-limiting example, component placement location restrictor 80 is shown in the form of a cut-out 84 formed in system support surface 24.

Cut-out 84 includes a first edge 86 and a second edge 89. In one non-limiting example shown in FIG. 4, first edge 86 includes a first end portion 92 positioned at about three-quarters of the surface width "W" from first side edge 71 and a second end portion 94. First edge 86 terminates at least at about a mid-point of surface depth "D". Of course, it should be understood that the particular dimensions of cut-out 84 may vary and may depend on the particular systems arranged on system support surface 24. Second edge 89 includes a first end section 98 that connects with second end portion 94 of first edge 86 and a second end section 100 that terminates at second side edge 73 at a position that is about half the depth of system support surface 24.

At this point, it should be understood that component placement location restrictor 80 may take on various forms, including obstacles, walls, or other structure that may confine the placement of a component to a specific forward area of system support surface 24, and should not be considered as being limited to a cut-out or a material void. It should be further understood that the dimensions as well as the placement (i.e., location on system support surface 24) of component placement location restrictor 80 may vary.

Figure 4:
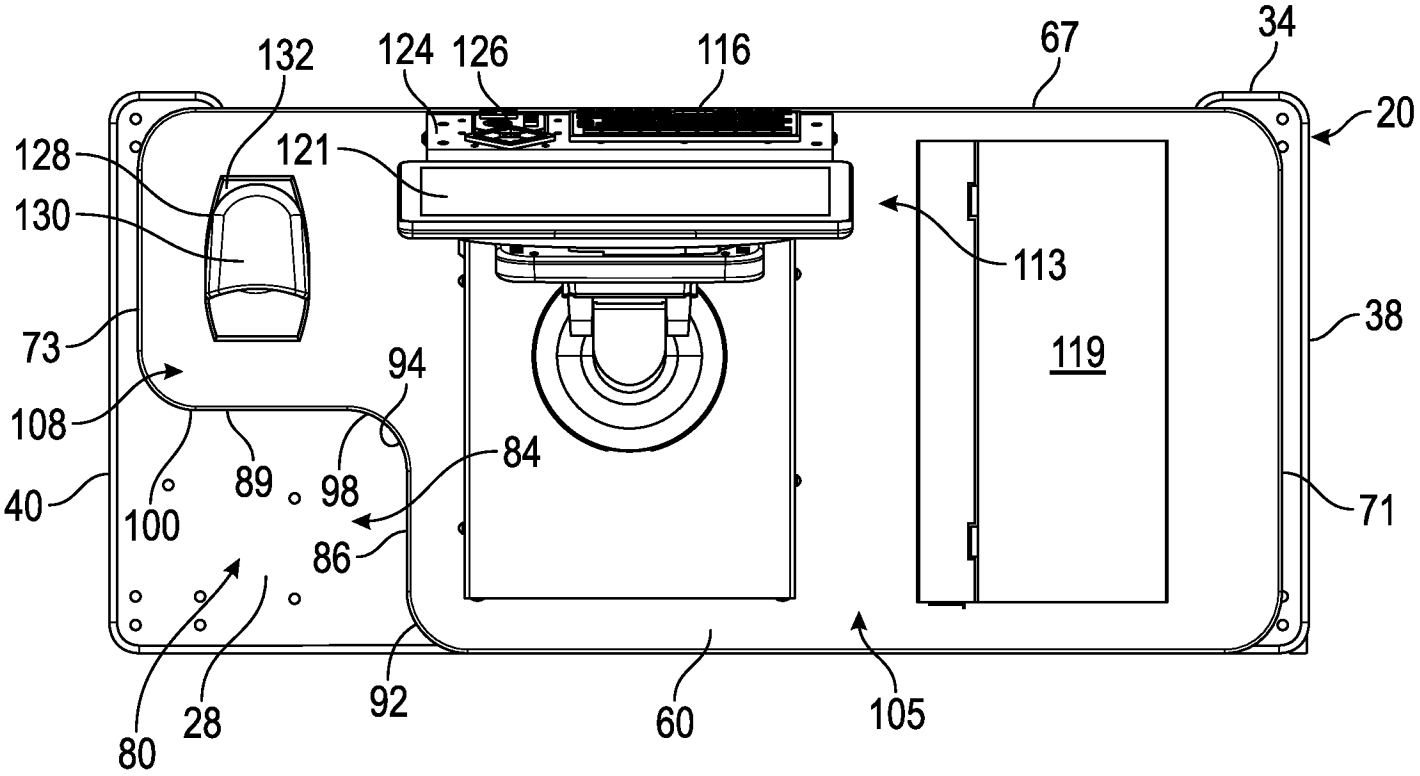
FIG. 4 is a top plan view of the postal service cart of FIG. 1, in accordance with a non-limiting example.

In a non-limiting example, system support surface 24 depicted in FIG. 4, includes a first support zone 105 defined between first side edge 71 and first edge 86 of cut-out 84 and a second support zone 108 defined between first edge 86 of cut-out 84 and second side edge 73. A first customer interface system 113 is arranged in first support zone 105. First customer interface system 113 includes a system support 117 and a printer 119. System support 117 may include a cavity (not shown) that may house electrical connections and the like. An all-in-one computer system 121 is arranged on system support 117. All-in-one computer system 121 includes an integrated computer system and monitor. All-in-one computer system 121 is operatively connected with a keyboard 124 and an interface 126 that may provide audible prompts for vision impaired customers.

In a non-limiting example, a second customer interface system 128 is arranged in second support zone 108. Second customer interface system 128 takes the form of a scanner 130 having a support 132. While shown as a single integrated component, scanner 130 and support 132 may be separate elements. Scanner 130 may be used to scan one-dimensional bar codes and/or two-dimensional bar codes such as quick response (QR) codes to generate a pre-paid postage label which may be printed on printer 119. Component placement location restrictor 80 ensures that scanner 130 in second support zone 108 is readily accessible by all customers and cannot be placed to far from forward edge 67 making access difficult to a patron that may be have reach limitations.

In another non-limiting example, a customer may use all-in-one computer system 121 to select and pay for a postage label which may then be printed at printer 119. In a non-limiting example, in order to support customer postage efforts, forward edge 67 of system support surface may be provided with a measurement device such as a ruler 134 that can be used to measure package size. In addition, mobile customer service station 10 may include a scale (not shown) for weighing packages or an optical measurement system (also not shown) that may scan and measure package dimensions which may be input directly into all-in-one computer 121. Still further, a customer may print out receipts that may include postal tracking information using printer 119.

As shown in FIG. 3, postal service cart 14 further includes a plurality of weight members, one of which is indicated at 140, arranged on second base surface 30. Weight members 140 are arranged so as to enhance stability of mobile customer service station 10. In addition to weight members 140, a plurality of wheels 143 and a plurality of levelers or leveling feet 146 are provided on second base surface 30. Levelers 146 may be retracted so that postal service cart 14 may be manipulated into position using wheels 143. Once in position, levelers 146 may be deployed to set first support surface 60 substantially level as desired. One or more of the plurality of wheels 143 may include wheel brakes or locks (not shown) that may be deployed prevent movement of mobile customer service station 10 when levelers 146 are not in use.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the non-limiting examples described herein. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof. Further, the use of terms "upper", "lower", "right", and "left" are merely exemplary and should not be considered to limit the scope of the non-limiting examples disclosed herein.

It will be understood by those skilled in the art that various changes may be made and equivalents may be substituted for elements thereof without departing from the scope of the non-limiting examples discussed herein. In addition, many modifications may be made to adapt a particular situation or material to the teachings of the disclosed non-limiting examples without departing from the essential scope thereof. Therefore, it is intended that the non-limiting examples disclosed herein not be limited to the particular examples disclosed, but will include all examples falling within the scope of the claims.

What is claimed is:

1. A postal service cart comprising:

a base member;

a support member extending from the base member, the support member including a first end connected with the base member and a second end; and a system support surface connected to the support member at the second end, the system support surface includes a first support zone configured to support a first portion of a customer interface system and a second support zone including a component placement location restrictor configured to support a second portion of the customer interface system, the component placement location restrictor confining placement of the second portion of the customer interface system to a selected section of the second support zone;

wherein the component placement location restrictor comprises a cut-out formed in the system support surface;

wherein the system support surface includes forward edge, a rear edge, a first side edge, and a second side edge, the forward edge being spaced from the rear edge by a surface depth and the first side edge being spaced from the second side edge by a surface width, the first side edge extending linearly from the forward edge to the rear edge;

wherein the cut-out includes a first edge that extends from the rear edge toward the forward edge, and a second edge that extends from the first edge toward the second side edge;

wherein a first end portion of the first edge terminates at the rear edge at about three-quarters (¾) of the surface width from the first side edge;

wherein a second end portion of the first edge connects with a first end section of the second edge;

wherein a second end section of the second edge terminates at the second side edge at about a mid-point of the surface depth.

2. The postal service cart according to claim 1, wherein the base member includes a first base surface and a second base surface that is opposite the first base surface, the support member being connected to the first base surface.

3. The postal service cart according to claim 2, wherein the base member includes a forward edge portion having a recess that extends into the first base surface and the second base surface.

4. The postal service cart according to claim 2, further comprising weight members mounted to the second base surface, the weight members enhancing stability of the postal service cart.

5. The postal service cart according to claim 2, further comprising: a plurality of wheels mounted to the second base surface.

6. The postal service cart according to claim 2, further comprising: a plurality of levelers mounted to the second base surface.

7. A mobile customer service system comprising:

a postal service cart including a base member, a support member extending from the base member, the support member including a first end connected with the base member and a second end, and a system support surface connected to the support member at the second end, wherein the system support surface includes a first support zone and a second support zone;

a first customer interface system including an input terminal supported on the system support surface in the first support zone;

a second customer interface zone including a component placement location restrictor is defined on the system support surface in the second support zone; and a second customer interface system arranged on the system support surface in the second support zone, the component placement location restrictor confining placement of the second customer interface system to a selected section of the second support zone;

wherein the component placement location restrictor comprises a cut-out formed in the system support surface;

wherein the system support surface includes forward edge, a rear edge, a first side edge, and a second side edge, the forward edge being spaced from the rear edge by a surface depth and the first side edge being spaced from the second side edge by a surface width, the first side edge extending linearly from the forward edge to the rear edge;

wherein the cut-out includes a first edge that extends from the rear edge toward the forward edge, and a second edge that extends from the first edge toward the second side edge;

wherein a first end portion of the first edge terminates at the rear edge at about three-quarters (¾) of the surface width from the first side edge;

wherein a second end portion of the first edge connects with a first end section of the second edge;

wherein a second end section of the second edge terminates at the second side edge at about a mid-point of the surface depth.

8. The mobile customer service system according to claim 7, wherein the base member includes a first base surface and a second base surface that is opposite the first base surface, the support member being connected to the first base surface.

9. The mobile customer service system according to claim 8, wherein the base member includes a forward edge portion having a recess that extends into the first base surface and the second base surface.

10. The mobile customer service system according to claim 8, further comprising weight members mounted to the second base surface, the weight members enhancing stability of the postal service cart.

11. The mobile customer service system according to claim 7, wherein the first customer interface system further comprises a printer.

12. The mobile customer service system according to claim 7, wherein the second customer interface system comprises a scanner.

* * * * *